US005357944A

United States Patent [19]

Rathmayr

[11] Patent Number: 5,357,944

[45] Date of Patent: Oct. 25, 1994

[54] FUEL INJECTION PUMP FOR INTERNAL COMBUSTION ENGINES

[75] Inventor: Heinz Rathmayr, Hallein, Austria

[73] Assignee: Robert Bosch GmbH, Stuttgart, Fed. Rep. of Germany

[21] Appl. No.: 69,336

[22] Filed: Jun. 1, 1993

[30] Foreign Application Priority Data

Aug. 22, 1992 [DE] Fed. Rep. of Germany ..... 4227851

[51] Int. Cl.[5] ..... F02M 51/06; F02M 57/02

[52] U.S. Cl. ..... 123/509; 123/506; 239/88

[58] Field of Search ..... 123/509, 506, 495, 458; 239/88–96, 124–126, 585.1

[56] References Cited

U.S. PATENT DOCUMENTS

| | | | |
|---|---|---|---|
| 4,129,256 | 12/1978 | Bader | 123/506 |
| 4,385,614 | 5/1983 | Eheim | 123/506 |
| 4,403,586 | 9/1983 | Taniguchi | 123/509 |
| 4,482,094 | 11/1984 | Knape | 239/88 |
| 4,760,831 | 8/1988 | Altdorf | 123/509 |
| 4,770,149 | 9/1988 | Kramer | 123/509 |
| 4,782,807 | 11/1988 | Takahashi | 123/506 |
| 4,829,646 | 5/1989 | Cigolotti | 123/495 |
| 5,094,215 | 3/1992 | Gustafson | 239/89 |
| 5,186,151 | 2/1993 | Schwerdt | 123/506 |
| 5,239,968 | 8/1993 | Rodriguez-Ammya | 123/506 |

FOREIGN PATENT DOCUMENTS

| | | | |
|---|---|---|---|
| 969829 | 6/1975 | Canada | 123/506 |
| 0117219 | 8/1984 | European Pat. Off. | 123/509 |
| 3718628 | 2/1988 | Fed. Rep. of Germany | 123/506 |
| 3728961 | 12/1990 | Fed. Rep. of Germany . | |
| 0125754 | 7/1985 | Japan | 123/506 |

*Primary Examiner*—Carl S. Miller

*Attorney, Agent, or Firm*—Edwin E. Greigg; Ronald E. Greigg

[57] ABSTRACT

The invention sets forth a fuel injection pump inserted into a housing of an internal combustion engine and comprising a single pump element that supplies a cylinder of the engine with fuel. The pump element comprises a pump body, which has a cylinder bore in which a pump piston, which defines a pump work chamber in the cylinder bore is axially guided and is moved back and forth by a cam drive counter to the force of a restoring spring. For simple manufacture of the pump body with great strength and tightness, this pump body is divided into a rotationally symmetrical cylinder liner and a rotationally symmetrical intermediate part, which are axially braced in line with a magnet valve via a resilient sleeve.

7 Claims, 1 Drawing Sheet

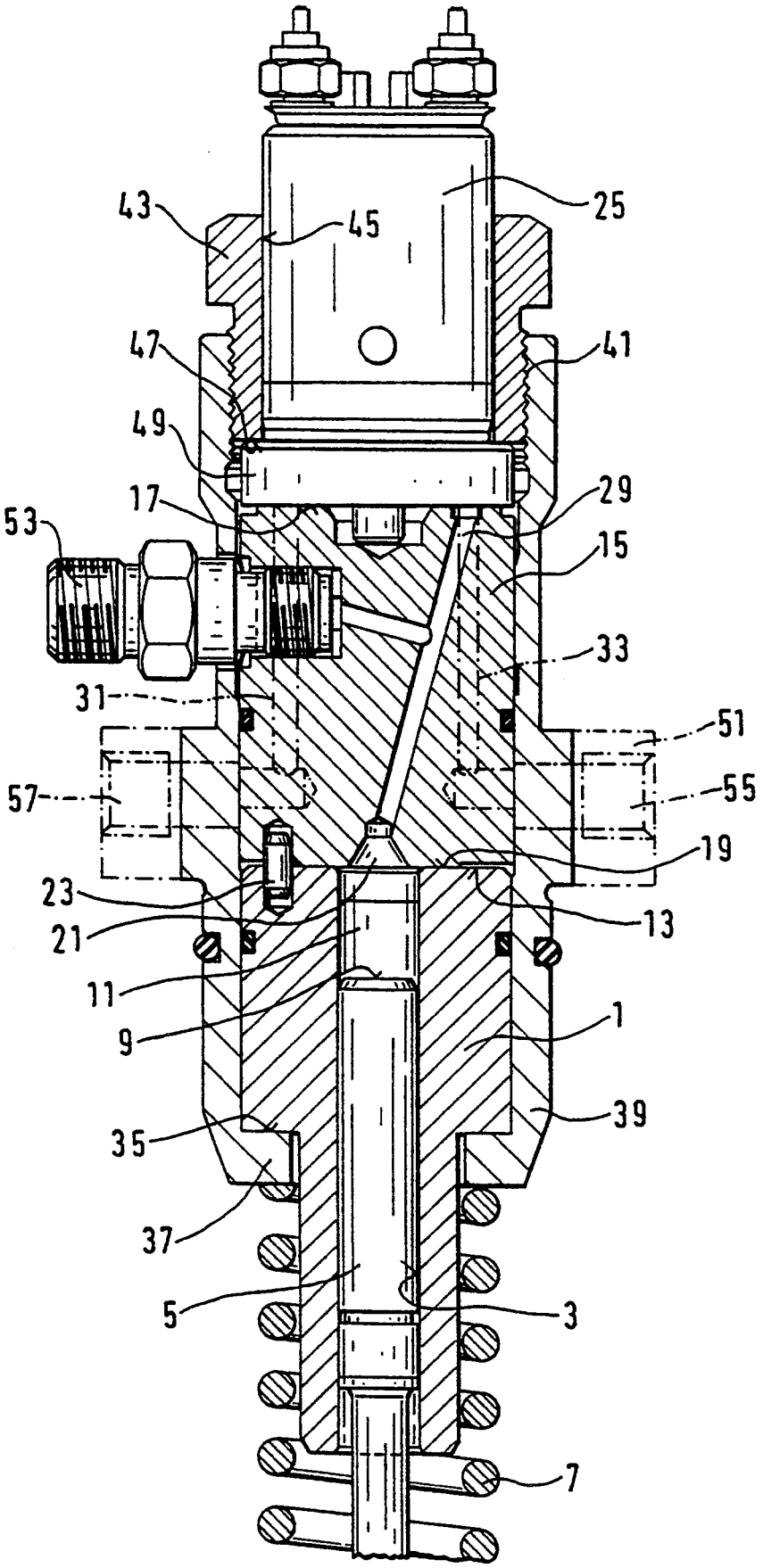
43
45
25
47
41
49
17
29
53
15
33
31
51
57
55
19
23
13
21
11
9
1
39
35
37
5
3
7

FUEL INJECTION PUMP FOR INTERNAL COMBUSTION ENGINES

BACKGROUND OF THE INVENTION

The invention is based on a fuel injection pump as defined hereinafter. In a fuel injection pump of this type, known from German Patent 37 28 961, a fuel injection pump, which comprises a pump element and supplies one cylinder of an engine with fuel, is inserted into the engine housing. The pump element is composed of a pump body that receives a cylinder liner and a pump piston guided in a cylinder bore of the cylinder liner; the pump piston is axially moved by a cam drive counter to the force of a restoring spring. With its face end remote from the cam drive, the pump piston defines a pump work chamber in the cylinder liner; via a fuel line in which a magnet-controlled reversing valve is disposed, this pump work chamber can be made to communicate with either a high-pressure line leading to a location where injection is effected into the combustion chamber of the engine to be supplied, or a line that discharges into a fuel-filled low-pressure chamber. All the connection points of the fuel inflow and outflow lines, the faces that effect sealing with respect to the magnet valve and the cylinder liner, and connecting conduits are disposed on the pump body; hence a great number of expensive machining operations, of varying precision, are needed.

This problem is even more pronounced in compact pump bodies, which are intended for use when the available installation space is small and are made as "monobloc" elements, and which, as known from German Offenlegungsschrift 39 43 183, not only have to have all the connections but also have to perform the function of the cylinder liner. Not only must the sealing faces at the connecting points for the fuel lines and adjacent components be machined, but the high-precision cylinder bore must be produced as well; because of the rotationally asymmetrical contour of the pump body, this requires a very major engineering effort and according is very expensive.

OBJECT AND SUMMARY OF THE INVENTION

The fuel injection pump according to the invention has an advantage over the prior art that because the pump body is assembled from a plurality of individual parts, it is simpler and hence less expensive to produce, and because of the axial bracing of the intermediate part with the cylinder liner and magnet valve as a result of the resilient sleeve, a high-pressure unit is formed, which assures reliable sealing of the various components from one another even at high feed pressures. In a way that is simple to achieve, the face ends of the components are embodied as ground faces. With the fuel injection pump according to the invention, it is accordingly possible to attain the advantages of a compact model, with its attendant heavy-duty capacity, with the production advantages of rotationally symmetrical individual parts; in terms of its shape, fit location, and connections, the resilient sleeve, which is simple to make and serves as a housing, can be embodied flexibly to meet the most various installation situations for engines.

A further advantage is attained in which a flange for securing the pump to the engine housing and receiving the connecting lines is embodied by the resilient sleeve itself, so that an additional means of fastening these parts becomes unnecessary.

The invention will be better understood and further objects and advantages thereof will become more apparent from the ensuing detailed description of a preferred embodiment taken in conjunction with the drawing.

BRIEF DESCRIPTION OF THE DRAWING

The sole FIGURE of drawing shows part of the fuel injection pump in longitudinal section through the pump piston axis, with the magnet valve adjoining it, along with the connections of the fuel lines.

DESCRIPTION OF THE PREFERRED EMBODIMENT

The fuel injection pump, of which only the part essential to the invention is shown in the drawing, comprises a cylinder liner 1, which has a cylinder bore 3 in which a pump piston 5 is guided that is moved axially, by a cam drive, not shown, counter to the force of a restoring spring 7. With its face end 9 remote from the cam drive, the pump piston 5 defines a pump work chamber 11 in the cylinder bore 3. The cylinder liner 1, with its face end remote from the cam drive and embodied as a sealing face 13, axially adjoins a cylindrical intermediate part 15, whose two face ends form an upper sealing face 17 and a lower sealing face 19; the lower sealing face 19, which rests on the sealing face 13 of the cylinder liner 1, has a blind bore 21 that defines the pump work chamber 11. For fixing the rotational position of the intermediate part 15 with respect to the cylinder liner 1, a close-fit bore is made in the face ends of each of these parts, and a set pin 23 is inserted into each bore.

A high-pressure conduit 29 beginning at the blind bore 21 is disposed in the interior of the intermediate part 15 and discharges into an injection line, not shown in detail but containing a pressure valve, leading into the injection location into the combustion chamber of the engine.

A magnet valve 25 comes to rest on the upper sealing face 17 of the intermediate part 15, remote from the blind bore 21, with its lower face end 25, which also serves as a sealing face and is machined accordingly. This magnet valve 25 is controlled electrically as a function of engine parameters and has a reversing valve, not shown in detail, with which, depending on its switching position, a bypass line 31 in the intermediate part 15 can be made to communicate with the high-pressure conduit 29 in such a way that during the pumping stroke of the pump piston 5, in order to control the high-pressure phase, either fuel flows out of the pump work chamber 11 into a low-pressure fuel line, or this line 31 is closed in order to develop the high injection pressure in the pump work chamber 11. In order to deliver low-pressure fuel to the pump work chamber 11 during the intake stroke of the pump piston 5, the intermediate part 15 also has an inflow line 23; the magnet valve 25 can again cause this inflow line 33 to communicate with the conduit 29 discharging into the pump work chamber 11, or else the inflow line 33 may discharge directly into the conduit 29, if it is secured against a reverse flow of fuel by a check valve that opens in the direction of the conduit 29.

On its outer circumference, the cylinder liner 1 has a shoulder 35 produced by a decrease in diameter in the direction of the cam drive, and by which it comes to rest on an annular shoulder 1 of a resilient sleeve 39 that encompasses the cylinder liner 1, intermediate part 15, and magnet valve 25. On the end of the annular shoulder 37 of the resilient sleeve 39 remote from the cylinder liner 1, one end of the restoring spring 7 is supported.

The inside diameter of this resilient sleeve 39 is just large enough that the cylinder liner 1, with its larger diameter toward the pump work chamber, the intermediate part 15, and a part of the magnet valve 25 adjoining the intermediate part, all three of which are embodied in this region with a circular cross section of approximately the same diameter, are insertable with a narrow clearance fit and axially guided one after the other in the resilient sleeve. In the region of the magnet valve 25, the inside diameter of the resilient sleeve 39 widens, and it has an internal thread 41, into which a tensioning nut 43 is screwed that guides the magnet valve 25 in an axial through bore 45 and with its screwed-in face end 47 acts upon an annular land 49 on the magnet valve 25 and keeps it pressed with the intermediate part 15 and the cylinder liner 1 against the annular shoulder 37 of the resilient sleeve 39 in such a way that via the various sealing faces at the face ends, a sealing contact is assured between the cylinder liner 1 and the intermediate part 15 and between the magnet valve 25 and the intermediate part 15. The function of the tensioning nut 43 may also be assumed by the magnet valve 25, if that valve has a thread on its outer circumference with which it can be screwed into the internal thread 41 of the resilient sleeve 39.

For fastening the resilient sleeve 39, which is inserted into an engine housing, along with the pump part braced in it, the outer circumference of this sleeve has a flange 51, which also receives a fuel connection 55 of the inflow line 33 and a fuel connection 57 of the bypass line 37. However, this flange may also be formed by an additional part that is slipped onto the resilient sleeve 39 and fastened to it which would greatly simplify the manufacture of the resilient sleeve 39.

The communication between the high-pressure conduit 29 extending in the intermediate part 15 and the pressure line leading to the injection location is made via a rotationally symmetrical mass-produced part in the form of a connection piece 53 that is screwed radially into the intermediate part 15 and protrudes through a bore in the resilient sleeve 39.

With the fuel injection pump according to the invention, the use of a compound pump body thus makes it possible, with great flexibility of installation, a compact structure, and simple manufacture of individual parts, to attain the kind of high-pressure strength that is attainable with a single-piece pump body. The fuel injection pump of the invention can be used both for injection systems that are formed of a pump, a line and an injection nozzle, and for unit fuel injector systems.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a pump element associated with a cylinder of the engine and insertable into a bore of a housing of the engine, the pump element comprising a pump body that has a cylinder bore (3) and a pump piston (5) that is guided therein, said pump piston includes an upper face end (9) that defines a pump work chamber (11), the pump piston being moved axially by a cam drive counter to a force of a restoring spring (7), the pump body is assembled to include a cylinder liner (1) and an intermediate part (15) upon which rests on an upper end a magnet valve (25), and that the cylinder liner (1), the intermediate part (15) and the magnet valve (25) are axially guided and braced sealingly against one another, in line with one another, by a resilient sleeve (39).

2. A fuel injection pump as defined by claim 1, in which the resilient sleeve (39), on one end, toward the restoring spring (7), has an annular inner shoulder (37), on which a shoulder (35) of the cylinder liner (1), comes to rest, and on its other end has an internal thread (41), into which a tensioning nut (43) supported on an annular land (49) on the magnet valve (25) is screwed.

3. A fuel injection pump as defined by claim 1, in which the magnet valve (25) has a thread, by which it is screwed into the internal thread (41) of the resilient sleeve (39) and in so doing presses the intermediate part (15) and the cylinder liner (1) against the inner shoulder (37) of the resilient sleeve (39).

4. A fuel injection pump as defined by claim 2, in which the magnet valve (25) has a thread, by which it is screwed into the internal thread (41) of the resilient sleeve (39) and in so doing presses the intermediate part (15) and the cylinder liner (1) against the inner shoulder (37) of the resilient sleeve (39).

5. A fuel injection pump as defined by claim 1, in which the adjoining axial face ends of the cylinder liner (1), intermediate part (15) and magnet valve (25) are embodied as machined, planar sealing faces.

6. A fuel injection pump as defined by claim 2, in which the resilient sleeve (39) has a flange (51) on its outer circumference for fastening to a housing of the engine and connections (55, 57) for an inflow and outflow of fuel.

7. A fuel injection pump as defined by claim 6, in which the flange (51) and the fuel line connections (55, 57) are formed by an additional component slipped onto the resilient sleeve (39).

* * * * *